US006191538B1

(12) United States Patent
Hirschmann et al.

(10) Patent No.: US 6,191,538 B1
(45) Date of Patent: Feb. 20, 2001

(54) HIGH-PRESSURE DISCHARGE LAMP HAVING A BASE AT ONE END AND A STARTING DEVICE INTEGRATED IN THE BASE

(75) Inventors: Guenther Hirschmann; Arnulf Rupp, both of Munich (DE)

(73) Assignee: Patent-Treuhand-Gesellschaft fuer elektrische Gluehlampen mbH, Munich (DE)

( * ) Notice: Under 35 U.S.C. 154(b), the term of this patent shall be extended for 0 days.

(21) Appl. No.: 09/515,400

(22) Filed: Feb. 29, 2000

(30) Foreign Application Priority Data

Mar. 4, 1999 (DE) ..... 199 09 529

(51) Int. Cl.[7] ..... H05B 37/00

(52) U.S. Cl. ..... 315/240; 315/177; 315/225; 315/243; 315/283

(58) Field of Search ..... 315/225, 177, 315/283, 284, 240, 242, 243, 362

(56) References Cited

U.S. PATENT DOCUMENTS 4,890,041 * 12/1989 Nuckolls et al. ..... 315/225

FOREIGN PATENT DOCUMENTS 9853647 11/1998 (WO) .

* cited by examiner

*Primary Examiner*—David Vu
(74) *Attorney, Agent, or Firm*—Carlo S. Bessone

(57) ABSTRACT

The invention relates to a high-pressure discharge lamp having a base at one end and whose return conductor (13) is protected with the aid of a bidirectional trigger (D) against high induced voltages of the radio interference suppression reactor (L1) connected to the return conductor (13).

7 Claims, 3 Drawing Sheets

Figure 1:
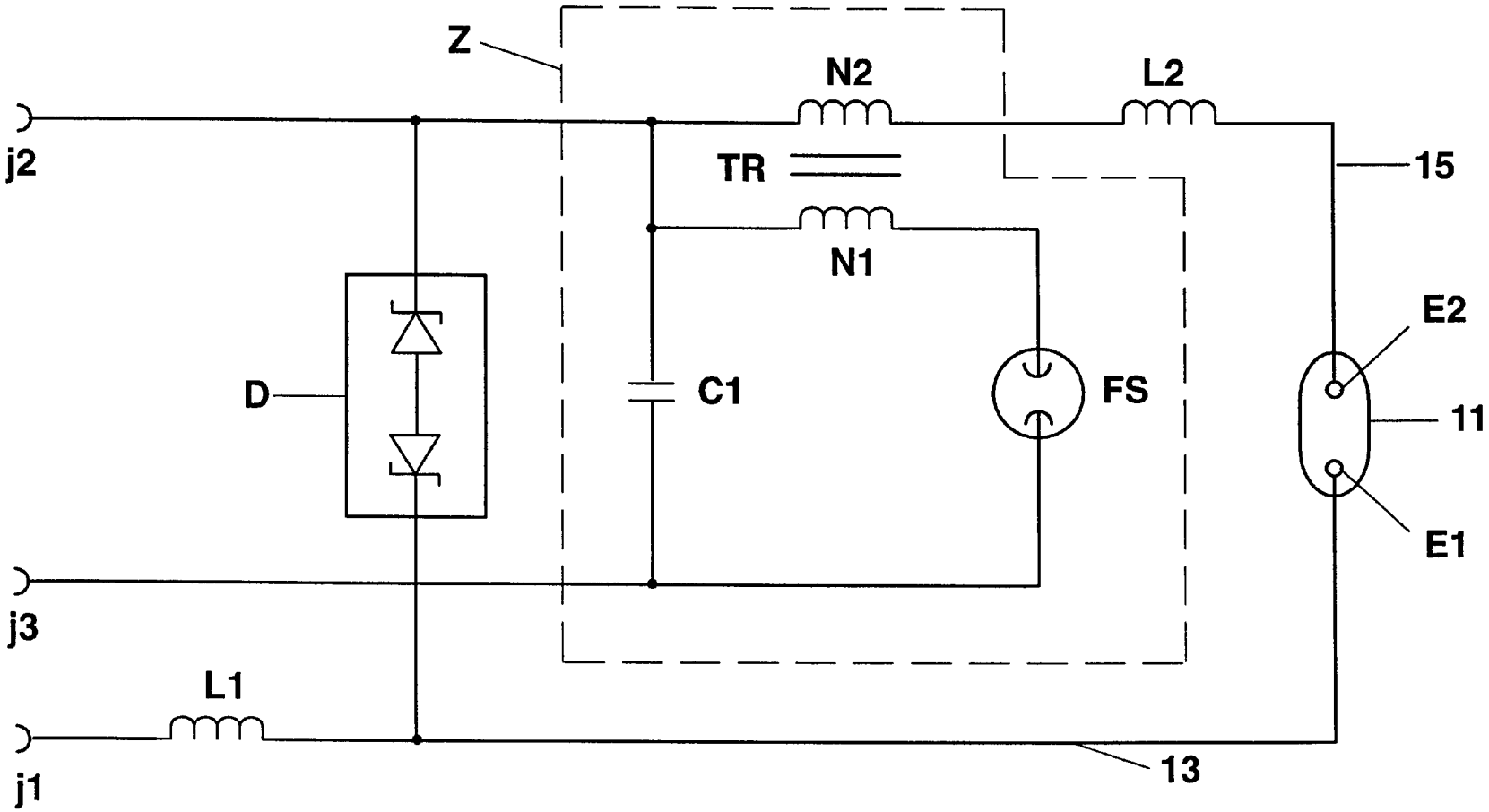

HIGH-PRESSURE DISCHARGE LAMP HAVING A BASE AT ONE END AND A STARTING DEVICE INTEGRATED IN THE BASE

The invention relates to a high-pressure discharge lamp having a base at one end in accordance with the preamble of patent claim 1.

I. PRIOR ART

Such a high-pressure discharge lamp is disclosed, for example, in the international patent application having the publication number WO 98/53647. This laid-open patent application describes a high-pressure discharge lamp having a base at one end and a pulse starting device arranged in the base. Accommodated additionally in the base is at least one radio interference suppression reactor which is connected via a supply lead to a gas discharge electrode of the high-pressure discharge lamp. One of these supply leads is constructed as a return conductor led back to the base from the end of the discharge vessel remote from the base. This return conductor runs outside the lamp vessel and has in part no electric insulation. The high voltage required to start the gas discharge in the discharge vessel is fed to the high-pressure discharge lamp, for safety reasons, via the supply lead near the base, which lead is completely surrounded by the lamp vessels or by the base. The gas discharge electrode remote from the base is connected to the frame potential via the return conductor during operation of the lamp so that no high electric voltages occur on the return conductor, which is only partially electrically insulated, during the operation of the lamp.

However, high electric voltages do occur during the starting phase in the radio interference suppression reactors, which serve to suppress radio interference of the lamp current. As a result, high-voltage pulses of up to 6 kV are applied, in particular, to the insufficiently electrically insulated return conductor during the starting phase, despite its connection to the frame potential.

II. SUMMARY OF THE INVENTION

It is the object of the invention to provide a high-pressure discharge lamp having a base at one end and a starting device integrated in the base, which ensures a substantial reduction in the voltage present on the return conductor during the starting phase.

According to the invention, this object is achieved by the characterizing features of patent claim 1. Particularly advantageous designs of the invention are described in the subclaims.

The high-pressure discharge lamp having a base at one end according to the invention has a base with at least two electric terminals for supplying voltage to the high-pressure discharge lamp, and a discharge vessel which is sealed at both ends and has a sealed end near the base and a sealed end remote from the base. Enclosed in the discharge vessel is an ionizable filling for producing a light-emitting gas discharge. Moreover, at least one radio interference suppression reactor and a starting device for starting a gas discharge in the discharge vessel are arranged in the base. Furthermore, the high-pressure discharge lamp according to the invention has at least two gas discharge electrodes arranged inside the discharge vessel, at least one first gas discharge electrode being connected to one first electric terminal of the high-pressure discharge lamp via a return conductor led out from the end remote from the base and via the at least one radio interference suppression reactor, and at least one second gas discharge electrode being connected to a second electric terminal of the high-pressure discharge lamp by means of a supply lead led out from the end near the base. According to the invention, the return conductor is connected to the second electric terminal of the high-pressure discharge lamp via a bidirectional trigger arranged in the base, and the first electric t erminal is connected to the second electric terminal of the high-pressure discharge lamp via the at least one radio interference suppression reactor and via the bidirectional trigger. The bidirectional trigger advantageously makes thermal contact with a heat sink.

The voltage drop across the return conductor during the starting phase is limited to at most 1 kV by the abovementioned features according to the invention, thus avoiding electric flashovers from the return conductor onto electrically conducting components arranged in the environment, in particular onto the metallized reflector surface, and, furthermore, thus preventing damage owing to voltage overloading of the operating unit connected to the high-pressure discharge lamp. It is advantageous to make use as bidirectional trigger of a varistor or a bidirectional diode circuit, since these components are particularly suitable for high voltages and high currents. If the breakdown voltage of these components is exceeded, they can convert into heat the electric energy released, even in the case of relatively high short-circuit currents. The bidirectional diode circuit is advantageously designed in such a way that it has two oppositely series-connected Zener diodes as equivalent circuit. It is particularly well suited to limiting high-frequency voltages and/or for limiting voltage pulses both of negative and of positive polarity. This diode circuit is, for example, a bidirectional diode arrangement marketed by the SGS Thomson company under the tradename of Transil™ diode.

The bidirectional trigger is advantageously dimensioned such that it has a breakdown voltage of at least 600 V and a clamping voltage of at least 800 V, without incurring damage.

III. DESCRIPTION OF THE PREFERRED EXEMPLARY EMBODIMENTS

Figure 2:
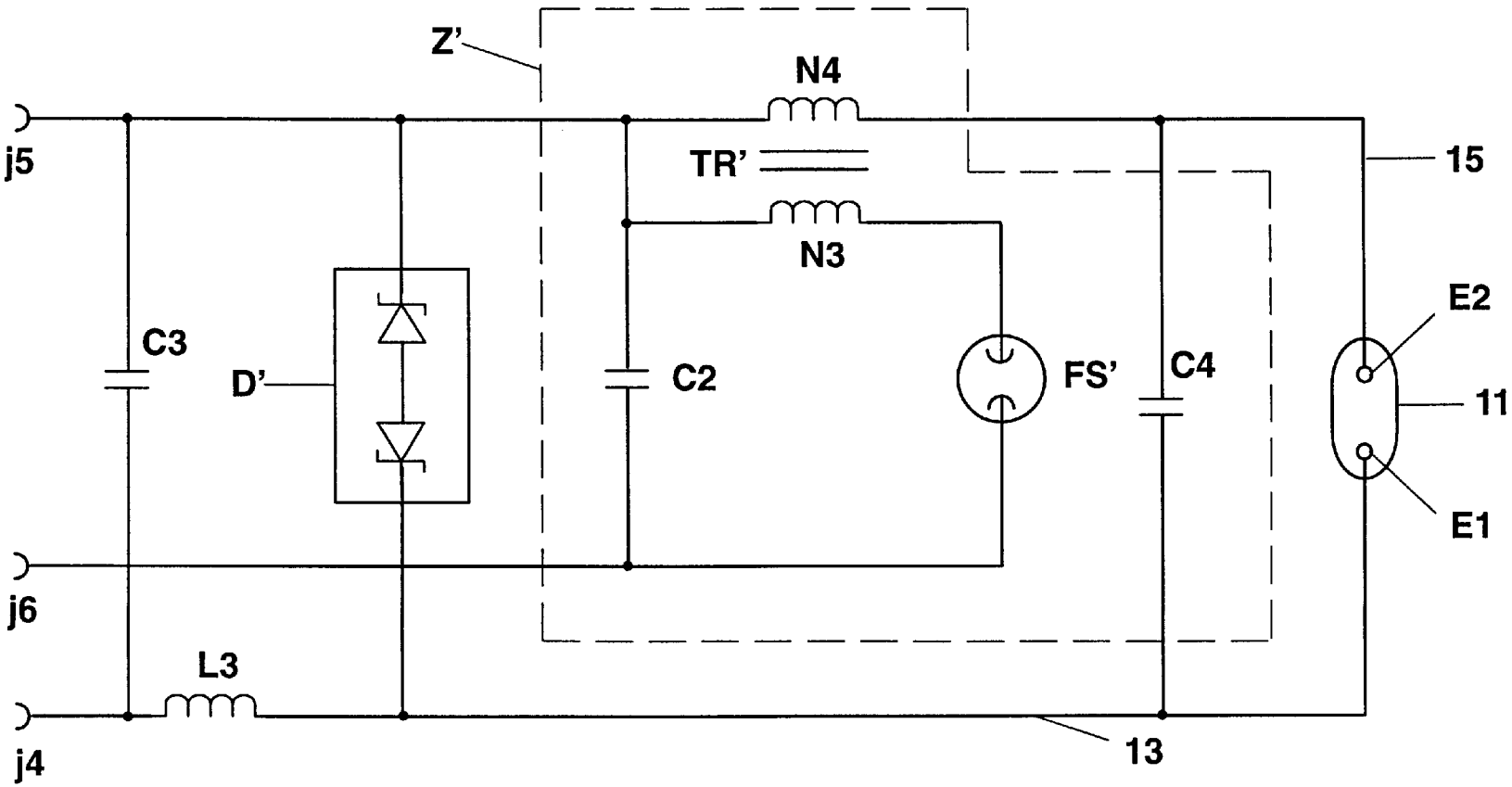
Figure 3:
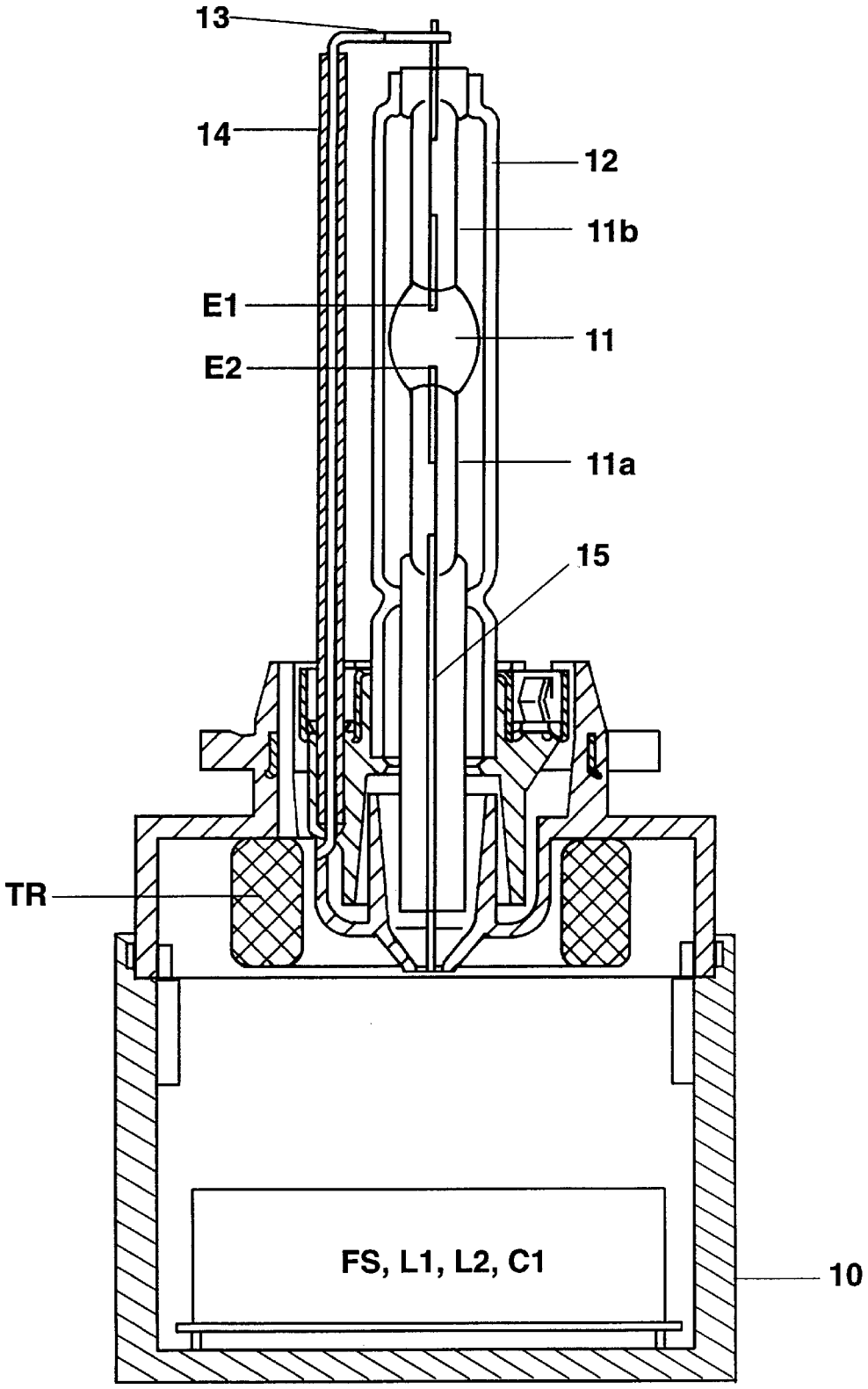

The invention is explained in more detail below with the aid of two preferred exemplary embodiments. In the drawing:

FIG. 1 shows a schematic representation of the circuit arrangement arranged in the base of the high-pressure discharge lamp according to the invention, in accordance with the first exemplary embodiment, FIG. 2 shows a schematic representation of the circuit arrangement arranged in the base of the high-pressure discharge lamp according to the invention, in accordance with the second exemplary embodiment, and FIG. 3 shows a cross section through the high-pressure discharge lamp according to the invention, in a schematic representation.

Shown in the preferred exemplary embodiment, illustrated in FIG. 3, of the high-pressure discharge lamp according to the invention, is a metal-halide high-pressure discharge lamp having a base at one end and an electric power consumption of approximately 35 W, which is provided for use in a motor vehicle headlight. The high-pressure discharge lamp LP has a base 10 and a discharge vessel 11, which is sealed at both ends and has an end 11*a* near the base and an end 11*b* remote from the base. The discharge vessel 11 is surrounded by a vitreous outer bulb 12 fastened on the discharge vessel. The subassembly comprising the discharge vessel 11 and the outer bulb 12 is anchored in a holding device of the base 10. An ionizable filling and two gas discharge electrodes E1, E2 are enclosed in the discharge vessel 11 in order to produce a light-emitting gas discharge. The gas discharge electrode E1 remote from the base is connected to a first radio interference suppression reactor L1 or L3 arranged in the base 10 via a return conductor 13 which is led out from the discharge vessel end 11*b* remote from the base and led back to the base 10. The section of the return conductor 13 running along the outer bulb 12 is surrounded by a ceramic insulation 14. The gas discharge electrode E2 near the base is connected to the secondary winding N2 or N4 of a starting transformer TR or TR' of a pulse starting device Z or Z', likewise arranged in the base 10, via a supply lead 15 which is led out from the discharge vessel end 11*a* near the base and runs completely inside the base 10 or inside the lamp vessels 11, 12.

FIG. 1 shows the starting circuit arrangement according to the first exemplary embodiment, which is arranged in the base 10 of the high-pressure discharge lamp LP and comprises the pulse starting device Z and the radio interference suppression reactors L1, L2 as well as the bidirectional trigger D. The pulse starting device Z comprises a starting transformer TR with a primary winding N1 and a secondary winding N2, as well as the starting capacitor C1 and the spark gap FS. The gas discharge electrode E1 remote from the base is connected to a first electric terminal j1 of the base 10 via the return conductor 13 and via the first radio interference suppression reactor L1. Moreover, the gas discharge electrode E1 remote from the base is connected to a second electric terminal j2 of the base 10 via the return conductor 13 and via the bidirectional trigger D. The first electric terminal j1 is connected to the second electric terminal j2 via the first radio interference suppression reactor L1 and via the bidirectional trigger D. The gas discharge electrode E2 near the base is connected to the second electric terminal j2 of the base 10 via the supply lead 15, via the second radio interference suppression reactor L2 and via the secondary winding N2 of the transformer TR. A third electric terminal j3 of the base 10 is connected to the second electric terminal j2 of the base 10 via the starting capacitor C1. The series circuit comprising the primary winding N1 of the starting transformer TR and the spark gap FS is arranged in parallel with the starting capacitor C1. The second electric terminal j2 and the third electric terminal j3 serve as voltage input for the pulse starting device Z. When the high-pressure discharge lamp LP is being mounted in the motor vehicle, the three electric terminals j1, j2, j3 (not illustrated in FIG. 3) of the base 10 are connected to corresponding terminals of an operating unit which is arranged in the motor vehicle and generates the supply voltage for the starting device Z at the terminals j2, j3, and the operating voltage for the high-pressure discharge lamp LP at the terminals j1, j2. The terminal j1 is also connected to the internal circuit frame potential of the operating unit.

In order to start the gas discharge in the discharge vessel 11 of the high-pressure discharge lamp LP, the starting capacitor C1 is charged via its connection to the voltage input j1, j3. Once the voltage drop across the starting capacitor C1 reaches the breakdown voltage of the spark gap FS, the starting capacitor C1 is discharged suddenly via the primary winding N1 of the transformer TR. In the secondary winding N2 of the transformer TR, this causes induction of high-voltage pulses of up to 25 kV which are applied to the gas discharge electrode E2 near the base. Once the gas discharge has been started, a lamp current flows through the high-pressure discharge lamp, that is to say via the discharge path E1–E2, and through the two radio interference suppression reactors L1, L2 as well as via the terminals j1, j2. The two radio interference suppression reactors L1, L2 serve to suppress the radio interference of this discharge current through the lamp. During the starting phase, voltage pulses of up to 6 kV are also induced in the two radio interference suppression reactors L1, L2. Consequently, correspondingly high voltage pulses occur during the starting phase, particularly on the return conductor 13, which is only incompletely insulated by the ceramic tube 14, although the return conductor 13 is connected to the internal circuit frame potential via the terminal j1. During the starting phase, the bidirectional trigger D is connected in series with the radio interference suppression reactor L1, with the result that the sum of the operating voltage provided at the terminals j1, j2 and the induction voltage of the radio interference suppression reactor L1 is present at the trigger D. If the sum of these voltages exceeds the breakdown voltage of the trigger D, the trigger D becomes electrically conductive. The electric energy stored in the radio interference suppression reactor L1 is then produced via the bidirectional trigger D.

The breakdown voltage of the bidirectional trigger D is at least 550 V. Moreover, it is dimensioned such that the clamping voltage is between 550 V and at most 740 V. In the case of voltages above the breakdown voltage, an electric current which leads to heating of the trigger D flows through the trigger D. The trigger D therefore makes thermal contact with a heat sink. A diode arrangement marketed by the SGS Thomson company under the name of bidirectional Transil™ diode is used as bidirectional trigger D. This bidirectional diode circuit D has two oppositely series-connected Zener diodes as equivalent circuit. The amplitude of the high-frequency high-voltage pulses generated by the radio interference suppression reactor L1 during the starting phase, which are applied to the return conductor 13, is limited by the bidirectional diode circuit D to a maximum value of 1 kV. Electric flashovers from the return conductor 13 onto the headlight reflector, in which the high-pressure discharge lamp is arranged, are therefore not to be feared.

The starting circuit arrangement according to the second exemplary embodiment, which is arranged in the base 10 of the high-pressure discharge lamp LP and comprises the pulse starting device Z' and the radio interference suppression reactor L3 as well as the bidirectional trigger D', is represented in FIG. 2. The pulse starting device Z' comprises a starting transformer TR' with a primary winding N3 and a secondary winding N4, as well as the starting capacitor C2, a capacitor C4 connected in parallel with the discharge path E1–E2 of the lamp, and the spark gap FS'. The gas discharge electrode E1 remote from the base is connected to a first electric terminal j4 of the base 10 via the return conductor 13 and via the radio interference suppression reactor L3. Moreover, the gas discharge electrode E1 remote from the base is connected to a second electric terminal j5 of the base 10 via the return conductor 13 and via the bidirectional trigger D'. The first electric terminal j4 is connected to the second electric terminal j5 via the radio interference suppression reactor L3 and via the bidirectional trigger D'. Connected in parallel with the terminals j4 and j5 is a capacitor C3 which limits the voltage rise dU/dt between these two terminals j4, j5. The gas discharge electrode E2 near the base is connected to the second electric terminal j5 of the base 10 via the supply lead 15 and via the secondary winding N4 of the transformer TR'. A third electric terminal j6 of the base 10 is connected to the second electric terminal j5 of the base 10 via the starting capacitor C2. The series circuit comprising the primary winding N4 of the starting transformer TR' and the spark gap FS' is arranged in parallel with the starting capacitor C2. The second electric terminal j5 and the third electric terminal j6 serve as voltage input for the pulse starting device Z'. When the high-pressure discharge lamp LP is being mounted in the motor vehicle, the three electric terminals j4, j5, j6 (not illustrated in FIG. 3) of the base 10 are connected to corresponding terminals of an operating unit which is arranged in the motor vehicle and generates the supply voltage for the starting device Z' at the terminals j5, j6, and the operating voltage for the high-pressure discharge lamp LP at the terminals j4, j5. The terminal j4 is also connected to the internal circuit frame potential of the operating unit. This circuit arrangement differs from the circuit arrangement in accordance with the first exemplary embodiment by the additional capacitors C3, C4 and by virtue of the fact that it has only one instead of two radio interference suppression reactors. One radio interference suppression reactor L3 also suffices to suppress the radio interference of the lamp current. The starting voltage for the high-pressure discharge lamp is provided at the capacitor C4. During the starting phase, the bidirectional trigger D' is connected in series with the radio interference suppression reactor L3, with the result that the sum of the operating voltage provided at the terminals j4, j5 and the induction voltage of the radio interference suppression reactor L3 is present at the trigger D'. If the sum of these voltages exceeds the breakdown voltage of the trigger D', the trigger D' becomes electrically conductive. The electric energy stored in the radio interference suppression reactor L3 is then reduced via the bidirectional trigger D'. The breakdown voltage of the bidirectional trigger D' is at least 550 V. Moreover, it is dimensioned such that the clamping voltage is between 550 V and at most 740 V. In the case of voltages above the breakdown voltage, an electric current which leads to heating of the trigger D' flows through the trigger D'. A diode arrangement marketed by the SGS Thomson company under the name of bidirectional Transil™ diode is used as bidirectional trigger D'. This bidirectional diode circuit D' has two oppositely series-connected Zener diodes as equivalent circuit. The high-frequency high-voltage pulses which occur during the starting phase on the return conductor 13 and which are conditioned by the induction voltage pulses occurring at the radio interference suppression reactor L3 are therefore limited to a value of at most ±1 kV. The capacitor C3 limits the voltage rise dU/dt of these high-voltage pulses.

The invention is not limited to the exemplary embodiments explained in more detail above. For example, it is also possible to use a varistor, a Sidac or a thyristor as bidirectional triggers D, D'. Moreover, it is also possible to use a bidirectional diode circuit comprising at least two oppositely polarized, series-connected Zener diodes as bidirectional triggers D, D'.

What is claimed is:

1. A high-pressure discharge lamp having a base at one end and the base (10) which has at least two electric terminals (j1, j2; j4, j5) for supplying voltage to the high-pressure discharge lamp, a discharge vessel (11) which is sealed at both ends and has a sealed end (11*a*) near the base and a sealed end (11*b*) remote from the base, an ionizable filling, which is enclosed in the discharge vessel (11), for producing a gas discharge, at least one radio interference suppression reactor (L1; L3) arranged in the base (10), at least two gas discharge electrodes (E1, E2) arranged inside the discharge vessel (11; 21), at least one first gas discharge electrode (E1) being connected to a first electric terminal (j1; j4) of the high-pressure discharge lamp via a return conductor (13) led out from the end (11*b*) remote from the base and via the at least one radio interference suppression reactor (L1; L3), and at least one second gas discharge electrode (E2) being connected to a second electric terminal (j2; j5) of the high-pressure discharge lamp by means of a supply lead (15) led out from the end (11*a*) near the base, and a starting device (Z; Z'), arranged in the base (10), for starting a gas discharge in the discharge vessel (11), wherein the return conductor (13) is connected to the second electric terminal (j2; j5) of the high-pressure discharge lamp via a bidirectional trigger (D; D') arranged in the base (10), and the first electric terminal (j1; j4) is connected to the second electric terminal (j2; j5) of the high-pressure discharge lamp via the at least one radio interference suppression reactor (L1; L3) and via the bidirectional trigger (D; D').

2. The high-pressure discharge lamp having a base at one end as claimed in claim 1, wherein the bidirectional t rigger (D; D') is a varistor, a Sidac or a thyristor.

3. The high-pressure discharge lamp having a base at one end as claimed in claim 1, wherein the bidirectional trigger (D; D') is constructed as a bidirectional diode circuit.

4. The high-pressure discharge lamp having a base at one end as claimed in claim 3 , wherein the bidirectional diode circuit (D; D') comprises at least two oppositely polarized, series-connected Zener diodes.

5. The high-pressure discharge lamp having a base at one end as claimed in claim 3, wherein the equivalent circuit diagram of the bidirectional diode circuit (D; D') comprises two oppositely polarized, series-connected Zener diodes.

6. The high-pressure discharge lamp having a base at one end as claimed in claim 1, wherein the bidirectional trigger (D; D') makes thermal contact with a heat sink.

7. The high-pressure discharge lamp having a base at one end as claimed in claim 1, wherein the starting device (Z; Z') is a pulse starting device which has at least a transformer (TR; TR'), a spark gap (FS; FS') and a capacitor (C1; C2).

* * * * *